US006247984B1

(12) United States Patent
Hatcher

(10) Patent No.: US 6,247,984 B1
(45) Date of Patent: Jun. 19, 2001

(54) STEERABLE TOWCRAFT WITH SIDE FINS

(75) Inventor: Phillip James Hatcher, Ashgrove Qld (AU)

(73) Assignee: Kwik Tek, Inc., Denver, CO (US)

( * ) Notice: Subject to any disclaimer, the term of this patent is extended or adjusted under 35 U.S.C. 154(b) by 0 days.

(21) Appl. No.: 09/414,768

(22) Filed: Oct. 7, 1999

(51) Int. Cl.[7] ..... B63B 1/00
(52) U.S. Cl. ..... 441/66; 441/129; 114/253
(58) Field of Search ..... 114/144 R, 162, 114/345, 351, 253; 441/65, 66, 67, 129, 131, 132

(56) References Cited

U.S. PATENT DOCUMENTS

| | | | | |
|---|---|---|---|---|
| 1,503,624 | * | 8/1924 | Bauman et l. | 441/132 |
| 5,279,510 | * | 1/1994 | Remy | 114/345 |
| 5,702,278 | * | 12/1997 | Boucher | 114/345 |

* cited by examiner

*Primary Examiner*—Stephen Avila
(74) *Attorney, Agent, or Firm*—Sheridan Ross P.C.

(57) ABSTRACT

A steerable towcraft is provided with a steering fin mounted on a lateral surface to allow the user to control the direction of travel of the towcraft while being pulled behind a watercraft.

15 Claims, 2 Drawing Sheets

STEERABLE TOWCRAFT WITH SIDE FINS

FIELD OF THE INVENTION

The present invention relates to towcraft which are pulled behind a watercraft, and more specifically inflatable towcraft with a steering mechanism interconnected to a side body for enhanced maneuverability.

BACKGROUND OF THE INVENTION

Towcraft such as inflatable inner tubes, rafts and other similar devices are popular recreational devices most commonly pulled behind both boats and jet skis. Traditionally, the rider(s) hangs onto one or more handles or a rope and has little or no control of the direction of travel of the towcraft. Rather, the rider of the towcraft is left to the mercy of the driver of the motor boat or jet ski, which can often be dangerous if there are debris, swimmers or other obstacles floating in the water.

Attempts have previously been made to make towcraft more controllable, such as described in U.S. Pat. No. 5,819,680. In this invention, two steering ropes with handles are provided which are independent of the towline and allow the rider to selectively pull the ropes to help control the direction of travel of the towcraft. Unfortunately, the steering mechanism is awkward, with the rider required to pull the rope in a direction opposite the direction of desired travel. That is, if a left hand turn is desired, the right hand rope must be pulled. Likewise, if a right hand turn is desired, the left hand rope must be pulled. Thus, the steering mechanism is difficult to use, dangerous and generally ineffective to make quick, abrupt turns if an obstacle is present in the water. Alternatively, other types of towcraft have fins or sponsons positioned on the bottom surface of the towcraft and pointed in a forward direction. These fins are effective at keeping the towcraft traveling in a forward position. Unfortunately, these types of fins are not useful for steering the towcraft in a desired direction in a quick, efficient manner.

Thus, there is a need for a towcraft steering mechanism which is inexpensive, simplistic in design and effective to allow enhanced steering and maneuverability of the towcraft.

SUMMARY OF THE INVENTION

It is thus an object of the present invention to provide an inexpensive steering mechanism for a towcraft to enable a rider to steer and maneuver the towcraft while being towed behind a watercraft such as a motor boat or jet ski.

It is yet another object of the present invention to provide a steering mechanism which can be retrofitted on existing towcraft or integrally provided on the towcraft during manufacturing.

It is yet a further object of the present invention to provide a steering mechanism for a towcraft which allows the user to hold on to existing handles positioned on the towcraft, requires no additional ropes, fins or rudders, and which allows the user to steer in a desired direction of travel by simply leaning in a preferred direction.

It is another object of the present invention to provide a steerable towcraft which has an attachment mechanism for interconnection to a towline which is positioned proximate to the center of the towcraft as opposed to the forward end of the towcraft. This positioning allows enhanced maneuverability.

Thus, in one aspect of the present invention, a floating towcraft adapted for being pulled by a boat over a surface of water is provided and comprises:

a) an upper surface, a lower surface adapted for contacting the water and a left side surface and a right side surfaced position therebetween;

(b) a means for interconnecting a forward end of said floating towcraft to a towline;

(c) a first handle and a second handle positioned on substantially opposing sides of said upper surface of said towcraft and positioned for grasping by a user of said towcraft; and (d) a first steering fin attached to said left side surface and a second steering fin attached to said right side surface, each of said steering fins positioned above said water surface until said user of said towcraft leans in direction of said respective fin, wherein said towcraft turns in that respective direction.

DETAILED DESCRIPTION OF THE PREFERRED EMBODIMENT

Figure 1:
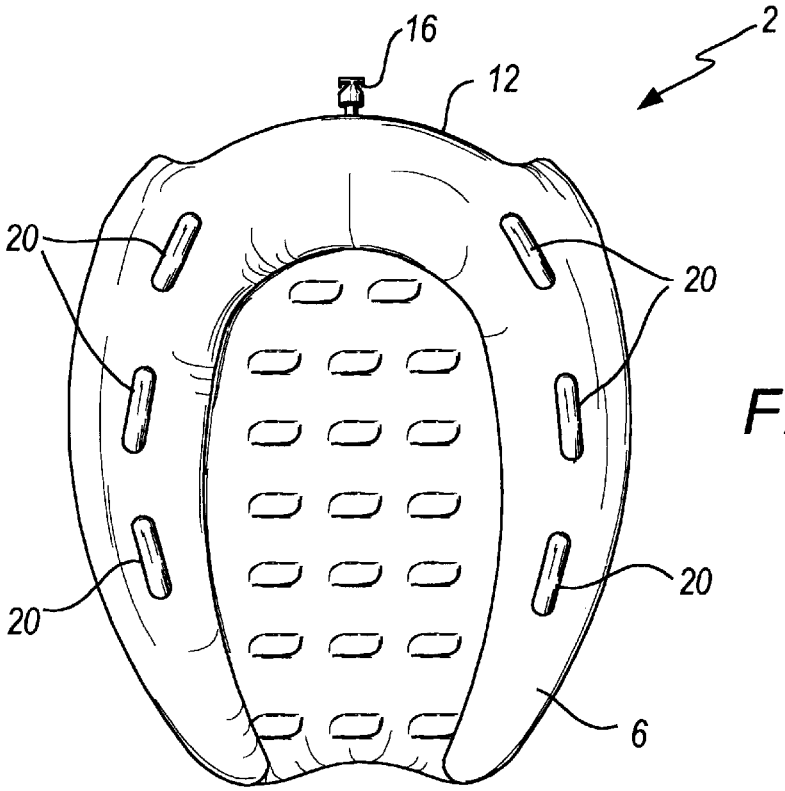
FIG. 1 is a stop plan view of a steerable towcraft.

Referring now to the drawings, FIG. 1 through FIG. 4 are various views of a steerable towcraft 2 with side fins as discussed herein. FIG. 1 is a top plan view of the steerable towcraft, identifying generally a upper surface 6 and at least two opposing handles positioned on the upper surface 6 of the towcraft 2. The steerable towcraft 2 generally has a horseshoe shape with a towline attachment bracket 16 positioned on the front end 12. However, as appreciated by one skilled in the art, the shape of the towcraft 2 is not limited by a horseshoe shape but rather could have any practical geometric shape or size.

The tow line attachment bracket 16 is generally comprised of a plastic or rubber material bonded or stitched to the front end of the steerable towcraft 2, and is used to attach a tow rope. The other end of the towline is interconnected to a watercraft such as a motorboat or jet ski. Alternatively, the attachment bracket 16 or other similar attachment means may be positioned proximate to the center of the towcraft 2, or slightly forward of the center. This positioning enhances the maneuverability of the towcraft 2 since the pint of rotation and pivoting is located more towards the towcraft center of gravity. Thus, during use, the steerable towcraft 2 moves in a forward direction as the steerable towcraft 2 is pulled by the watercraft. The occupants of the steerable towcraft 2 generally sit within the horseshoe shape of the steerable towcraft 2 or alternatively kneel or lie down while holding on to the handles for safety. Although various sizes of the steerable towcraft 2 are available, in this particular embodiment shown in the drawings there is sufficient room for one, two or three occupants, each having opposing handles 20 to hold on to during use.

Figure 2:
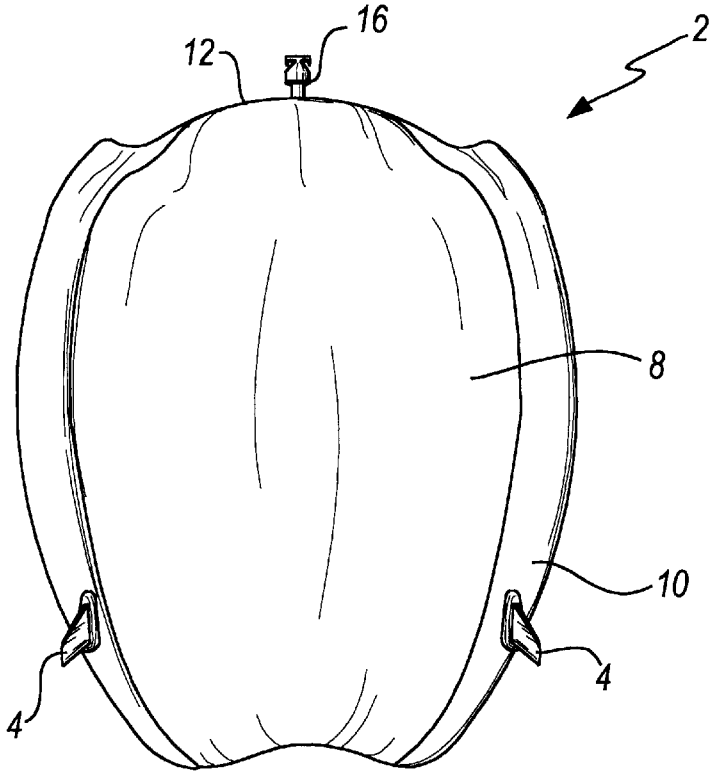
FIG. 2 is a bottom plan view of the steerable towcraft shown in FIG. 1.

Referring now to FIG. 2, a bottom plan view of the steerable towcraft 2 shown in FIG. 1 is depicted. In this drawing, the bottom surface 8 of the steerable towcraft II is identified which generally is in contact with the water surface. The lateral surface 10 of the steerable towcraft 2 is additionally identified which represents the two side portions positioned between the top surface 6 and the bottom surface 8. The lateral surface 10 is elevated above the water when the steerable towcraft is floating. Additionally seen in this particular drawing are the steering fins 4 positioned on the lateral surface 10 of the steerable towcraft 2. As seen, the steering fins 4 are positioned out of the water during normal use.

The steering fin 4 is generally comprised of a plastic material such as polyethylene or polypropylene, although other type of materials such as fiberglass or metal could be used for the same purpose. The fin 4 is preferably interconnected to the lateral surface 10 of the steerable towcraft II during manufacturing of the steerable towcraft 2. The steering fin 4 is thus permanently interconnected to the lateral surface 10 of the steerable towcraft II at a preferred location. However, it is one aspect of the present invention that the steering fins 4 could be retrofitted on any type of towcraft by the use of a strong epoxy, stitching or other bonding method to retrofit existing water towcraft to enable them to have the steering feature discussed herein.

Preferably, the steering fin is about 3 to 4 inches in length, with a fin depth of approximately 2 to 10 inches. However, any combination of sizes could be used depending on the application of use and the size of the towcraft.

Figure 3:
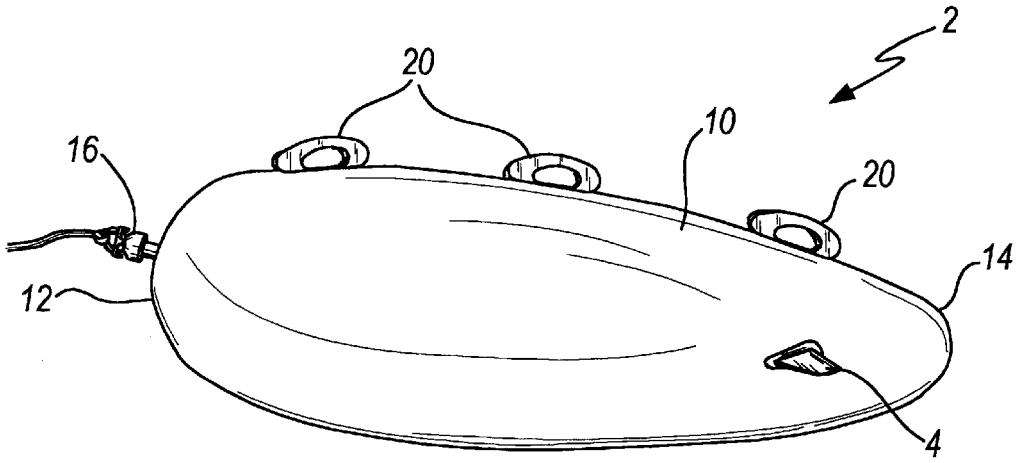
FIG. 3 is a side elevation view of the steerable towcraft shown in FIG. 1.
Figure 4:
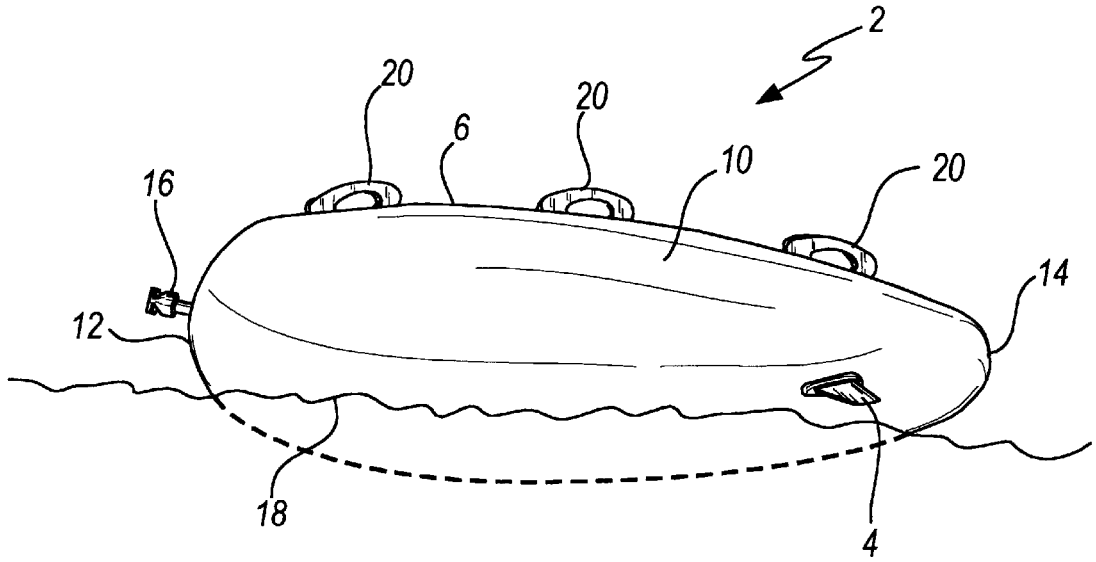
FIG. 4 is an enlarged side elevation view of the steerable towcraft shown in FIG. 1 and further depicting the steering fin position while the towcraft is floating in water.

Referring now to FIG. 3 and FIG. 4, a left elevation view of the steerable towcraft II is provided with the craft positioned in a normal floating position in the water. As seen in this particular drawing, the steering fins 4 are positioned above the water surface 18 during normal use. However, as the steerable towcraft is tilted to activate a turning maneuver, the steering fin 4 dips into the water, and thus initiates a turn in the respective direction of lean by the occupant. Thus, if the occupant wants to turn left, the right handle is pulled while the rider leans to the left, thus allowing the left steering fin 4 to dip into the water. It is also feasible although not shown in these particular drawings to add one or more additional steering fins 4 on the lateral surface 10 of the steerable towcraft 2 in a position forward of the steering fin 4 shown in drawings 3 and 4 to enhance maneuverability.

In use, the steerable towcraft is boarded by one to three occupants and towed behind a watercraft such as a motorboat or a jet ski by means of a towline. The towline is interconnected on one end to the watercraft and a second end to the towline attachment bracket 16. As the steerable towcraft 2 is pulled, the rider is kneeling or sitting within the horseshoe shape of the steerable towcraft 2 and grasping the handles 20 located on the top surface 6 of the steerable towcraft 2.

When an obstacle is seen floating on the water surface 18 or the occupant simply wants to initiate a turning maneuver, the occupant leans in the direction of the desired turn while pulling on the opposing handle 20. This motion tilts the overall orientation of the steerable towcraft 2, thus pushing the steering fin 4 into the water surface. As the steering fin is pushed into the water surface, the steerable towcraft 2 begins turning immediately in that direction. This facilitates a turning motion until the occupant wants to begin returning the steerable towcraft II to a forward position. To facilitate the more forward position in a non-steering movement, the occupant merely releases pressure on the opposing handles 20, and stops leaning into the desired turn. This raises the steering fin 4 from the water surface, and once again allows the steerable towcraft 2 to travel in a forward direction. The steering capability of the steerable towcraft 2 may of course be used in any given direction left or right depending on the desired direction of turn by the occupant. Further, to enhance the steering capacity, two or more occupants can act in harmony to quickly and effectively steer the towcraft in a desired direction.

To help facilitate the understanding of the present invention, the following list of components and numbering as identified in the drawings are presented herein:

| Number | Component |
|---|---|
| 2 | Steerable towcraft |
| 4 | Steering fin |
| 6 | Top surface |
| 8 | Bottom surface |
| 10 | Lateral surface |
| 12 | Front end |
| 14 | Rear end |
| 16 | Towline attachment bracket |
| 18 | Water line |
| 20 | Handles |

While the invention has been described in combination with specific embodiments thereof, it is evident that many alternatives, modifications and variations would be compared to those skilled in the art in light of the foregoing description. Accordingly, it is intended to embrace all such alternatives, modifications, and variations as followed through the spirit and broad scope of the claims.

What is claimed is:

1. A floating, steerable towcraft adapted for being pulled by a boat over a surface of water, said floating towcraft comprising:

(a) an upper surface, a lower surface adapted for contacting the water surface and a left side surface and a right side surfaced position therebetween, said left side surface and said right side surface positioned at substantially right angles to said lower surface of said floating, steerable watercraft and positioned above the surface of water even when a rider is sitting on said floating, steerable towcraft;

(b) a means for interconnecting said steerable towcraft to a towline;

(c) a first handle and a second handle positioned on substantially opposing sides of said upper surface of said towcraft and positioned for grasping by a user of said towcraft; and (d) a first steering fin directly attached to said left side surface and a second steering fin directly attached to said right side surface, each of said steering fins positioned above said water surface until said user of said towcraft leans in direction of said respective fin, wherein said towcraft turns in that respective direction.

2. The floating towcraft of claim 1, wherein said first steering fin and said second steering fin are oriented respectfully on said left side surface and said right side surface in a direction transverse to the longitudinal axis of said left and said right surfaces.

3. The floating towcraft of claim 1, wherein said upper surface, said lower surface, and said right and said left surfaces are comprised of one integral inflatable tube.

4. The floating steerable towcraft of claim 1, wherein said steerable towcraft has a horseshoe shape with a forward portion of said steerable towcraft being the front of said horseshoe.

5. The steerable towcraft of claim 1, wherein said first steering fin and side second steering fin are comprised of plastic.

6. The steerable towcraft of claim 4, wherein an inflatable bladder is positioned between said upper surface, said lower surface and said left side surface and said right side surface to provide buoyancy for said floating, steerable towcraft.

7. The steerable towcraft of claim 1, wherein said means for interconnecting said steerable towcraft to a towline is positioned on a forward end of said towcraft between said lower surface and said upper surface.

8. The steerable towcraft of claim 1, wherein said means for interconnecting said steerable towcraft to a towline is positioned proximate to a center point of said towcraft on said lower surface.

9. A floating steerable towcraft adapted for being pulled by a towcraft across a surface of water, comprising:

(a) a horseshoe shaped inflatable tube having a front end, a rear end, a top surface and a bottom surface and respective lateral sides positioned therebetween, said lateral sides positioned at substantially right angles to said lower surface and remaining above a water line when said steerable towcraft is floating on the water surface;

(b) attachment means for reversibly interconnecting said towcraft to a towline;

(c) a handle positioned on said upper surface on a left side and a right side of said horseshoe shaped inflatable tube, said handles adapted for grasping by an occupant of said floating, steerable towcraft; and (d) a left steering fin directly interconnected to said left lateral side of said floating towcraft and a right steering fin directly interconnected to said right lateral side of said towcraft, said left and said right steering fins not in contact with the water surface when said towcraft is floating on said water surface, wherein when a rider of said towcraft leans in any given direction, the steering fin on that respective lateral side enters the water and steers the towcraft in that respective direction.

10. The steerable towcraft of claim 9, wherein said steering fins are comprised of plastic.

11. The steerable towcraft of claim 9, further comprising a durable shell covering extending over said inflatable tube to said protection to said inflatable bladder.

12. The steerable twocraft of claim 9, wherein said attachment means is positioned proximate to a center point of said steerable towcraft.

13. A floating, steerable towcraft adapted for being pulled by a watercraft across a body of water, comprising:

(a) an inflatable horseshoe shaped bladder;

(b) a durable horseshoe shaped shell covering adapted for receiving said inflatable horseshoe shaped bladder, said durable shell covering having a front end, a rear end, a top surface, a back surface and lateral side surfaces positioned between said top surface and said bottom surface, said lateral side surfaces not in contact with said body of water when said steerable towcraft is floating on the body of water and traveling in a forward direction;

(c) a towline attachment bracket interconnected to said durable shell covering which is adapted for removable interconnection to a towline attached to the watercraft; and (d) a first steering fin attached to a left lateral surface and a second steering fin attached to a right lateral surface of said steerable towcraft, said first and said second steering fins have an orientation transverse to a longitudinal direction of said right and said left lateral surfaces of said towcraft, each of said right and said left steering fins positioned above the water surface until a user of said towcraft leans in a direction of said respective fin, wherein said towcraft turns in that respective direction when said steering fin enters the water surface.

14. The floating, steerable towcraft of claim 13, wherein said towline attachment bracket is attached to a front end of said durable shell covering.

15. The floating, steerable towcraft of claim 13, wherein said towline attachment bracket is attached proximate to a center position on a said bottom surface of said durable shell covering.

* * * * *